US006241226B1

(12) United States Patent
Olsen et al.

(10) Patent No.: US 6,241,226 B1
(45) Date of Patent: Jun. 5, 2001

(54) VACUUM SYSTEM COUPLED TO A WAFER CHUCK FOR HOLDING WET WAFERS

(75) Inventors: Gregory A. Olsen, Tempe; Christopher J. Lichner; Phillip Rayer, II, both of Phoenix; Chad J. Voelkers, Mesa, all of AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/389,778

(22) Filed: Sep. 3, 1999

(51) Int. Cl.[7] ..... B23G 13/00
(52) U.S. Cl. ..... 269/15; 451/388; 269/21
(58) Field of Search ..... 269/21, 15; 451/456, 451/54, 388, 289; 134/1

(56) References Cited

U.S. PATENT DOCUMENTS 5,655,956 * 8/1997 Ferreira et al. ..... 451/388
5,797,789 * 8/1998 Tanaka et al. ..... 451/289
5,800,251 * 9/1998 Nakazato et al. ..... 451/289
5,897,425 * 4/1999 Fisher et al. ..... 451/289
6,067,977 * 5/2000 Wark et al. ..... 451/388
6,083,083 * 7/2000 Nishimura ..... 451/388

* cited by examiner

*Primary Examiner*—Joseph J. Hail, III
*Assistant Examiner*—Daniel Shanley
(74) *Attorney, Agent, or Firm*—Snell & Wilmer, L.L.P.

(57) ABSTRACT

The present invention relates to a vacuum system for reliably holding wafers exposed to effluents in a wafer chuck. A vacuum pump generates a vacuum communicated to a wafer chuck through a tank. The tank has a baffle for converting vapor effluent to liquid effluent from the air sucked into the vacuum system. The tank stores the liquid effluent to prevent the effluent from fouling the vacuum pump and other components. A pressure transducer is connected to the tank to detect a loss in vacuum that may indicate a lost wafer condition. A trap is placed between the tank and the vacuum pump to detect if excessive effluents have escaped from the tank and to signal that corrective action may need to be taken.

7 Claims, 2 Drawing Sheets

VACUUM SYSTEM COUPLED TO A WAFER CHUCK FOR HOLDING WET WAFERS

TECHNICAL FIELD

The present invention relates to a vacuum system coupled to a wafer chuck for holding an effluent covered wafer. The vacuum system is capable of detecting excessive effluent in the vacuum system, removing vapor and liquid effluents that have entered the vacuum system and detecting if a wafer has become dislodged from the wafer chuck.

BACKGROUND OF THE INVENTION

A flat disk or "wafer" of single crystal silicon is the basic substrate material in the semiconductor industry for the manufacture of integrated circuits. Semiconductor wafers are typically created by growing an elongated cylinder or boule of single crystal silicon and then slicing individual wafers from the cylinder. During the process of building and connecting the integrated circuits on the wafer, the wafer must be transported from processing station to processing station as well as transported within the same processing station many times. The devices that hold the wafers are generally referred to as wafer chucks. Common examples are wafer carriers (shown in FIG. 2) and robotic end effectors (shown in FIG. 3) that are commonly used in chemical-mechanical polishing machines as shown in U.S. Pat. No. 5,498,199.

Vacuum systems that are coupled to wafer chucks are well known in the art to assist in the transportation of the wafers. Common pressures within these vacuum systems are between −22 and −27 inHg. As long as the wafer is dry, vacuum systems experience very few failures in assisting a wafer chuck to hold and retain a wafer. However, during chemical-mechanical polishing, cleaning and other semiconductor processing steps, the wafer may be exposed to deionized (DI) water, slurry or other effluents used during the processing of the wafer.

A common problem for vacuum systems used to hold effluent covered wafers is that effluent may be sucked into the vacuum system and plug the valves or foul the vacuum pump. This problem is especially troublesome since the effluent sometimes enters a vapor stage under vacuum conditions making it difficult to effectively remove the effluent from the vacuum system.

Another common problem is that it is difficult to know when a wafer has accidentally been dislodged from the wafer chuck, known as a "lost wafer condition". If the wafer chuck continues to operate as if the wafer were still firmly held, a valuable wafer might be broken and other wafers and the processing station may also be damaged.

Yet another problem is that effluents can build up in the vacuum system and plug the vacuum lines, valves and vacuum pump. If this "excessive effluent condition" is not detected, it will cause the vacuum system to lose its vacuum thereby making it easier for the wafer to become dislodged from the wafer chuck.

What is needed is a vacuum system in fluid communication with a wafer chuck for reliably holding effluent covered wafers. The vacuum system must be able to remove vapor and liquid effluents that have entered the vacuum system and signal the system computer to take corrective action if a "lost wafer condition" or an "excessive effluent condition" is detected.

SUMMARY OF THE INVENTION

Thus it is an object of the present invention to provide an apparatus for reliably holding effluent covered wafers, which addresses and resolves the shortcomings of the prior art described above.

Another object of the present invention is to provide a vacuum system in fluid communication with a wafer chuck that is tolerant of effluents. The vacuum system must be able to remove the vapor and liquid effluents sucked into the vacuum system and store the effluents until they can be effectively removed.

Yet another object of the present invention is to provide a vacuum system in fluid communication with a wafer chuck that is able to detect a "lost wafer condition" or an "excessive effluent condition" and notify the processing station's computer so that the necessary actions may occur to correct for the detected condition and minimize the damage done to the wafer and the processing station.

In accordance with these and other objects of the present invention, a vacuum system in fluid communication with a wafer chuck has been invented for reliably holding a wafer during or between processing steps. The invention has a vacuum pump for generating a vacuum used by a wafer chuck to retain and hold a wafer. A tank is connected between the vacuum pump and the wafer chuck so as to be part of the vacuum system and in fluid communication with the wafer chuck and the vacuum pump. The tank is capable of knocking vapor effluent out of the air (returning the vapor effluent to a liquid state) sucked into the vacuum system and storing the liquid effluent until it can be conveniently discharged.

These and other aspects of the present invention are described in full detail in the following description, claims and appended drawings.

BRIEF DESCRIPTION OF THE DRAWINGS

The present invention will hereinafter be described in conjunction with the appended drawing figures, wherein like numerals denote like elements, and.

DETAILED DESCRIPTION OF PREFERRED EXEMPLARY EMBODIMENTS

Figure 1:
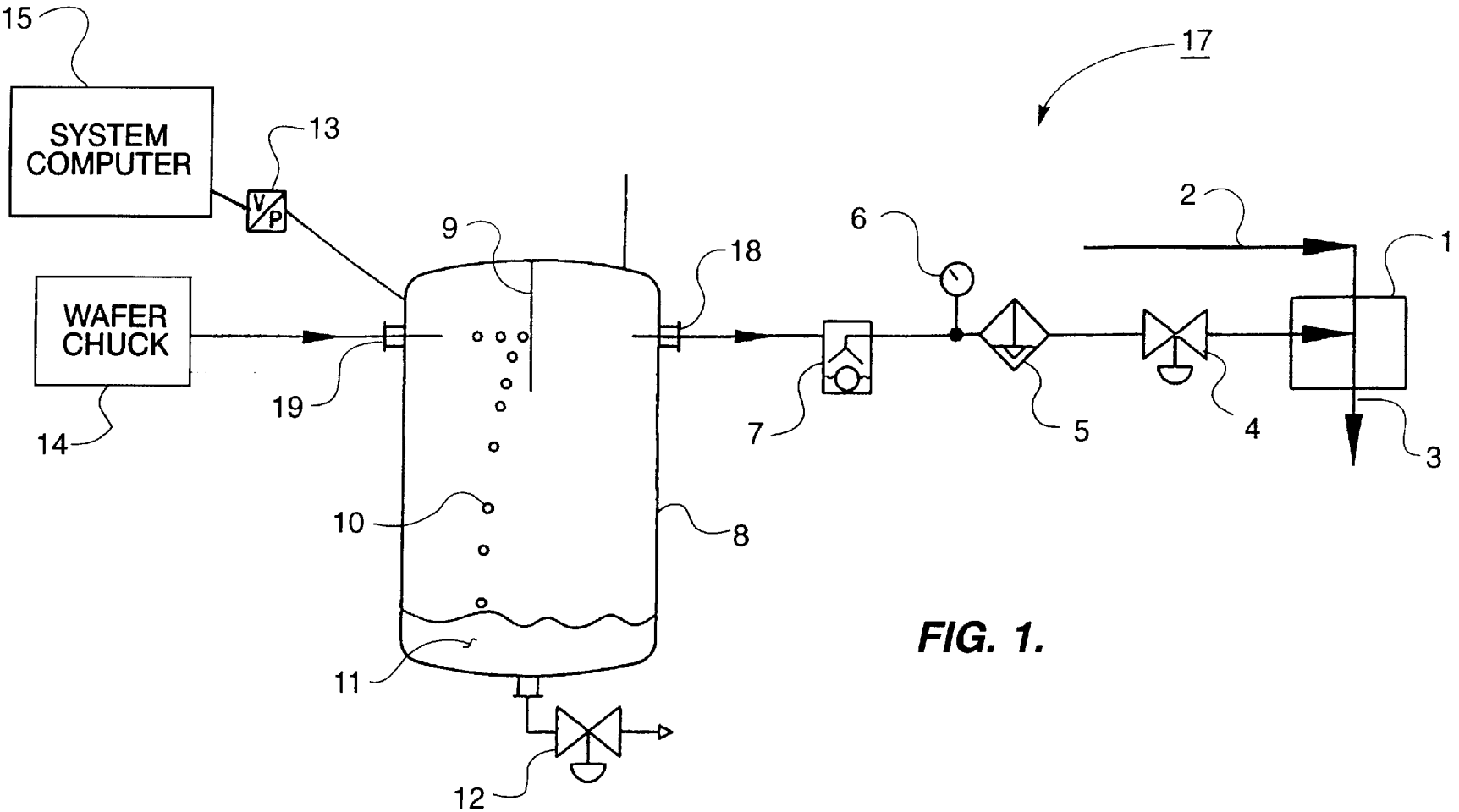
FIG. 1 is a schematic view of an exemplary configuration according to one embodiment of the present invention.

One possible exemplary embodiment of the present invention is illustrated in FIG. 1. A wafer 16 is sucked into and retained by a wafer chuck 14 in fluid communication with a vacuum pump 1 that generates a vacuum condition throughout the vacuum system 17. For simplicity in describing the current invention, the terms "vacuum" or "vacuum condition" will refer to any pressure below the ambient pressure (normally one atmosphere), but for the illustrated exemplary embodiment is preferably in the range of between −22 and −27 inHg.

Figure 2:
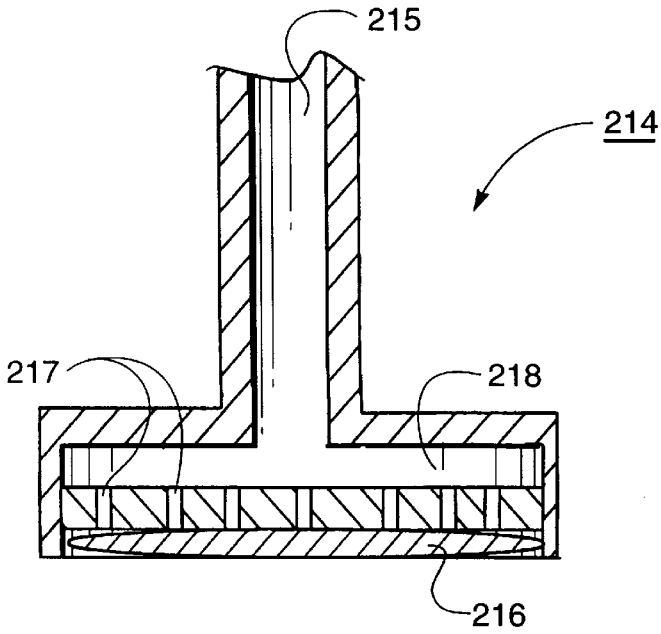
FIG. 2. (PRIOR ART)
FIG. 2 is a cross-sectional view of an exemplary prior art wafer chuck (carrier) used during a chemical-mechanical process.

The wafer chuck 14 may be any device used to hold a wafer 16 during a processing step or for transporting the wafer 16 between processing steps. FIG. 2 shows an exemplary wafer chuck known as a wafer carrier 214 used to hold the wafer 216 during a chemical mechanical polishing (CMP) process step. The wafer is likely to have been exposed to effluents, such as DI water or slurry during a CMP processing step. In this exemplary wafer carrier, an airtight passage way 215 communicates a vacuum from the vacuum system 17 to a chamber 218 within the wafer carrier 214. A plurality of holes 217 are created in the wafer support surface 219 (either a membrane or a rigid planar surface) that communicate the vacuum from the chamber 218 to the backside of the wafer 216 for effectively holding the wafer 216 to the wafer carrier 214.

Figure 3:
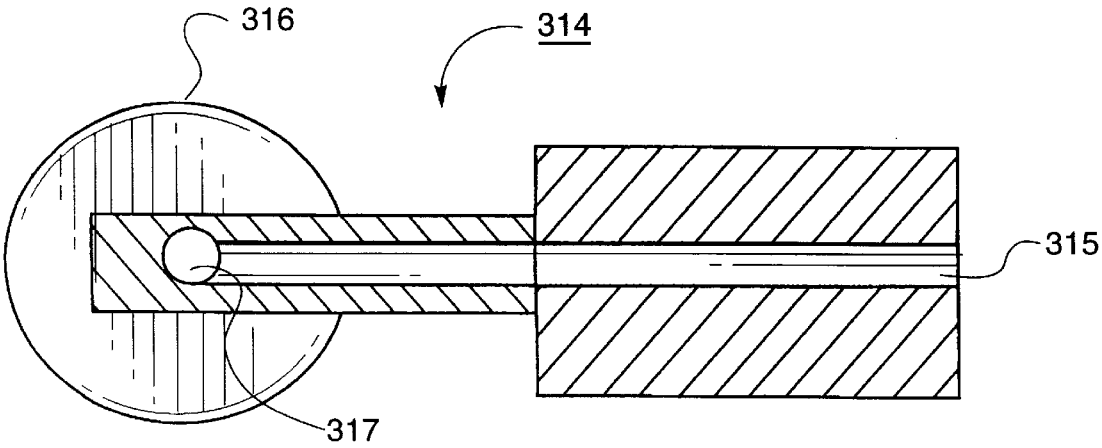
FIG. 3. (PRIOR ART)
FIG. 3 is a top-down view of an exemplary prior art wafer chuck (robotic endeffector) used to transport wafers.

FIG. 3 shows an exemplary wafer chuck known as a robotic endeffector 314 used to transport a wafer 316 between processing stations. In this exemplary robotic endeffector 314 (robot not shown), an airtight passage way 315 communicates a vacuum from the vacuum system 17 to a hole 317 that is positioned on a face of the wafer 316. The wafer 316 seals the hole 317 maintaining an airtight vacuum system 17 and effectively holding the wafer 316 to the robotic endeffector 314.

A small, single stage stainless steel tank 8 is connected to the vacuum system 17 between the wafer chuck 14 and the vacuum pump 1. The tank 8 is relatively small (preferably between 70 and 100 $cm^3$) to assist in shorter cycle times (preferably less than 20 seconds) to generate a vacuum in the vacuum system 17. In addition, the small tank also allows a small vacuum pump 1 to be used, lowering the cost and decreasing the size of the vacuum system 17.

The tank 8 has the capability of removing effluent 10 that is sucked into the vacuum system 17. The preferred method is to place a baffle 9 directly in the path of the vapor and liquid effluent in the air sucked into the vacuum system 17. The baffle 9 provides a mechanical separation means to return the vapor effluent to a liquid state that is more readily removed from the vacuum system 17. The liquid effluent 10 is then trapped in the bottom of the tank 8 as trapped effluent 11 which is held until it may be conveniently drained through effluent drain 12.

Effluent drain 12 may be coupled to the bottom of tank 8 for periodically draining the trapped effluent 11 from the vacuum system 17. The effluent drain 12 preferably has a wide opening to prevent the effluent from fouling the opening. The trapped effluent 11 is preferably drained when a wafer 16 is not being held by the wafer chuck 14 and may be accomplished with drain model #PES-075-SF made by Huntington Laboratories. The vacuum take-off opening 18 from the tank 8 may be situated on the opposite side of the baffle 9 from the inlet 19 and towards the top of the tank 8. Proper placement of the take-off opening 18 assists in minimizing the effluent 10 that is able to escape from the tank 8 towards the vacuum pump 1.

A pressure transducer 13 may be coupled to tank 8 to check for a loss of vacuum condition. A loss of vacuum condition may indicate that the wafer 16 is no longer engaged with the wafer chuck 14. The pressure transducer 13 may be configured to relay this error condition to the system computer 15 so that corrective action may be taken, such as initiating a controlled shut down. The pressure transducer 13 may be model #209 1/8 NPT made by Setra.

System computer 15 may be any type of computer or control system so long as it is able to detect an error signal from the pressure transducer 13 and alter the actions take by the processing station to reduce the chance of damaging the wafer 16 or processing station.

A trap 7 may be connected to the take-off opening 18 in the tank 8. The trap 7 may be used to detect excessive effluent in the vacuum system 17 that has escaped from the tank 8. If effluent reaches a certain level in the trap 7, the trap will block the vacuum line leading to the pump 1. This will effectively remove the vacuum from the tank 8 which loss of vacuum condition will be detected and handled by pressure transducer 13 as explained above. A model #AA673 trap made by GAST is suitable for this purpose.

A vacuum filter 5 may be connected to trap 7 as illustrated in FIG. 1. The purpose of vacuum filter 5 is to is to prevent contaminates within the vacuum system 17 from reaching the vacuum pump 1 which may be accomplished by a vacuum filter 5 model #S2P×1 made by Parker Hannifin.

A pressure gauge 6 may be connected to the vacuum system 17 between the trap 7 and the vacuum filter 6. The pressure gauge 6 is used to monitor the pressure level between the tank 8 and the vacuum pump 1 and may be model #S122 made by US Gauge.

Valve 4 may be connected to the vacuum system 17 between the vacuum filter 5 and the vacuum pump 1. The purpose of the valve 4 is to isolate the tank 8 from the vacuum pump 1 and allow the system to discharge the effluent 10. This may be accomplished, for example, by valve model #PVI-100-SFACSO made by Huntington Laboratories.

The vacuum pump 1 chosen should be tolerant of vapors such as a Venturi vacuum pump model #Miniflex X60L made by PIAB. The vacuum pump 1 removes air from the vacuum system 17 through the vacuum exhaust 3. The vacuum pump 1 has a supply air input 2 for returning air into the vacuum system 17 when the vacuum is no longer desired.

In operation, vacuum pump 1 removes the air in the vacuum system 17 through vacuum exhaust 3. The pressure in the vacuum system necessary to reliably hold the wafer 16 depends on many factors such as the size of the wafer 16, design of the wafer chuck 14 and the acceleration the wafer chuck 14 will experience during processing or transporting the wafer 16. In a preferred embodiment where the wafer chuck 14 is a chemical mechanical polishing carrier for a 200 mm wafer, a pressure of between −22 and −27 inHg has been found to reliably hold the wafer during transportation.

At least one hole in the wafer chuck 14 is necessary to apply a vacuum to a face of the wafer 16. The hole in the wafer chuck 14 may be situated so as to maximize the holding force on the wafer and to make sure a good seal is made with the wafer 16 so the vacuum system 17 remains airtight. The generally preferred location of the hole in the wafer chuck 14 is such that it makes contact at or near the center of the wafer 16.

This invention is optimized for the situation where the wafer 16 has been exposed to effluents 10 which would clog the drains or foul the vacuum pump 1 if the effluents were not timely removed from the vacuum system 17. Effluents 10 that have been sucked into the vacuum system 17 off of wafer 16 through a hole (217 in FIG. 2 or 317 in FIG. 3) in the wafer chuck 14 typically enter a vapor phase when introduced into the vacuum system 17. The vapor effluents 10 are mechanically knocked out of the vapor (returned to liquid form) by baffle 9. The trapped effluent 11 is then stored in the bottom of tank 8 until the trapped effluent 11 can be drained from the vacuum system through effluent drain 12. The trapped effluents are most efficiently drained when the vacuum system is not being used.

If a wafer 16 becomes dislodged from the wafer chuck 14, the pressure transducer 13 detects a lost vacuum condition as air is sucked into the vacuum system through the hole (217 in FIG. 2 or 317 in FIG. 3) in the wafer chuck 14. The pressure transducer 13 may then signal the system computer 15 that the wafer 16 has been dislodged from the wafer chuck 14 and that corrective action is required. The corrective action required is highly dependent on the particular processing station, but appropriate actions should be taken to avoid damaging the wafer 16 or the processing station.

If excessive effluent 10 has entered the vacuum system 17, the trap 7 will block the vacuum line to the vacuum pump 1, thereby preventing the effluent 10 from damaging the vacuum pump 1 and removing the vacuum from the tank 8. The pressure transducer 13 is then able to detect that the vacuum has been removed from the tank 8 and signal the system computer 15 to take corrective action as explained above. Part of the corrective action is likely to be to drain tank 8 through effluent drain 12 so as to remove the excessive and trapped effluent 11 from the tank 8. It will be understood that the foregoing description is of preferred exemplary embodiments of the invention and that the invention is not limited to the specific forms shown or described herein. Various modifications may be made in the design, arrangement and type of elements disclosed herein, as well as the steps of making and using the invention without departing from the scope of the invention as expressed in the appended claims. For example, while the present invention was described in terms for transporting wafers, other workpieces may be transported without deviating from the scope and spirit of the present invention.

We claim:

1. A wafer holding system for holding an at least partially effluent covered wafer, the system comprising:

(a) a vacuum pump for generating the vacuum in a vacuum system;

(b) a tank in fluid communication with a vacuum pump to receive effluent from the vacuum system;

(c) a wafer chuck in fluid communication with the vacuum system, the chuck adapted for holding the wafer to the wafer chuck by application of vacuum suction to a face of the wafer; and (d) a baffle placed inside the tank in a flow path of fluids drawn from the wafer chuck to separate any liquid effluent from the vapors in the fluids.

2. A wafer holding system as in claim 1, further comprising an effluent drain operably connected to the tank for periodically draining trapped effluent.

3. A wafer holding system as in claim 2, further comprising a pressure transducer operably coupled to the tank for detecting a lost vacuum condition due to the wafer disengaging from the wafer chuck.

4. A wafer holding system as in claim 3, further comprising a system computer to receive an error signal when the pressure transducer detects the wafer disengaging from the wafer chuck.

5. A wafer holding system as in claim 2, further comprising a trap located in the vacuum system in a path of fluid flowing between the tank and the vacuum pump, the trap comprising means for releasing the tank from vacuum conditions if a predetermined amount of effluent is contained in the trap.

6. A wafer holding system as in claim 5, further comprising a system computer to receive an error signal and take corrective action when the pressure transducer detects excessive effluent in the vacuum system.

7. A wafer holding system as in claim 2, wherein the vacuum, pump is a venturi vacuum pump.

* * * * *